US005193606A

United States Patent [19]

Behrends

[11] Patent Number: 5,193,606

[45] Date of Patent: Mar. 16, 1993

[54] RIGID CONTINUOUS CASTING STARTER BAR WITH FLEXIBLE END FOR STORAGE

[76] Inventor: Gunther Behrends, 1 Birchcrest Ave., Danbury, Conn. 06811

[21] Appl. No.: 833,181

[22] Filed: Feb. 10, 1992

[51] Int. Cl.[5] ..... B22D 11/08
[52] U.S. Cl. ..... 164/446; 164/426
[58] Field of Search ..... 164/446, 445, 426, 425

[56] References Cited

U.S. PATENT DOCUMENTS

| | | | |
|---|---|---|---|
| 3,521,697 | 7/1970 | Niskovskikh et al. | 164/445 |
| 3,930,533 | 1/1976 | Rokop et al. | 164/426 |
| 4,043,383 | 8/1977 | Isenberg et al. | 164/426 |
| 4,291,748 | 9/1981 | Langner | 164/446 X |
| 4,632,175 | 12/1986 | McVay et al. | 164/426 |
| 4,715,426 | 12/1987 | Klaucic | 164/426 |

FOREIGN PATENT DOCUMENTS

| | | | |
|---|---|---|---|
| 2604643 | 4/1988 | France | 164/445 |

*Primary Examiner*—J. Reed Batten, Jr.
*Attorney, Agent, or Firm*—Rogers & Scott

[57] ABSTRACT

The starter bar has a free end portion which is flexible for storage and a substantially rigid portion at the end which plugs the mold. The starter bar is constructed in discrete blocks secured to one side of a planar spine provided in segments and arranged end to end. Adjustable spacers in the form of tapered blocks are disposed between the blocks of the bar to allow the starter bar to be self-supporting in a curved configuration corresponding to the casting path. A more flexible spine in the end portion of the starter bar allows the starter bar to be curved to a tighter radius than that of the casting path while the blocks fan out in an unsupported configuration. A storage ramp is provided to support the flexible end in the stored position.

6 Claims, 5 Drawing Sheets

RIGID CONTINUOUS CASTING STARTER BAR WITH FLEXIBLE END FOR STORAGE

FIELD OF THE INVENTION

This invention relates to a starter bar used in continuous casting to plug the outlet of a mold containing molten metal and or leading the casting out of the mold through a curved casting train. In particular, this invention relates to an advantageous structure for the starter bar in which the leading end adjacent the casting is substantially rigid and the trailing end is flexible.

BACKGROUND OF THE INVENTION

Rigid starter bars are generally more desirable than flexible bars because they are inherently self-supporting and thus the support rolls and associated structure required for flexible bars can be momtted. Not only does this simplify the installation, it minimizes the equipment which would have to be maintained or replaced in the event of a catastrophic molten metal breakout from the mold.

A disadvantage of rigid bars is that they occupy a lot of space during storage in location already cramped with runout tables, platforms, overhead ranges and other equipment. This probe is addressed by flexible bars which may be stored in neither a flat configuration, or a curved configuration having a smaller radius of curvature than the casting train.

In U.S. No. 4,291,748 to Langner, it is proposed to combine the advantages of a rigid baer with those of a flexible bar by using a bar having a rigid potion disposed at the leading end adjacent the casting and a flexible portion at the tail end. The rigid portion is constructed from a single piece having a radius corresponding to that of the casting retain and has a length roughly equal to one-half the distance between the mold and the straightener. The flexible end comprises a number of solid long links each having a tongue and groove to cooperate with adjacent blocks and secured by through pins which permit limited, relative pivotal movement between the links so that the tail may be stored in a curved configuration to a radius which is smaller than that of the casting train.

While the proposal made in Langner to combine a rigid portion with a flexible portion is elegant, the structure described to achieve the claimed advantages has its own shortcomings. Because of its one piece construction, the rigid portion of the bar has to be manufactured within close tolerances in order for its shape to match the curvature of the casting arc.

In use, the rigid portion is subjected to pinch roll force in the straightener system and these tend to distort it geometry, and thus frequent reshaping or replacement of this component is required. Heat treatment to improve the properties of the material is not possible with the one piece construction because it would lead to unacceptable distortions.

The trailing flexible end of the bar has a tongue and groove construction typical of link-type bars and thus the typical problems encountered with this design, namely that the tongue and groove connections are reformed by frequent overrolling the straightener and a tendency for the connection to bind are also found in this portion of the starter bar. To remedy this situation by ample clearances causes unacceptable backlash problems of the starter bar system. Most systems built to this design have been replaced by entirely solid rigid dummy bars because it has been found impractical to maintain them.

An embodiment of a substantial solid rigid curved dummy bar is described in U.S. No. 3,930,533 to Rokop et al. This construction also suffers from the problem of distortion due to pinch roll forces and of space requirements for storage which Langner attempts to address.

It will be understood that the above-described problems become more pronounced in casting machines having larger casting radii.

An object of this invention to address the aforementioned problems in a starter bar having a rigid leading end and a flexible tail end.

SUMMARY OF THE INVENTION

In accordance with this invention, there is provided a starter bar for continuous casting of which one end is flexible and the outer end is substantially rigid The starter bar is constructed in discrete blocks secured on one side to a common spine. The spine is provided in segments which are arranged end to end and the spine segments are of a lighter more pliable construction in the flexible portion of the starter bar. This construction allows the starter bar to assume a curved configuration while spacing means disposed between respective blocks re positioned to make the starter bar self-supporting in a curved configuration which corresponds to the casting path.

The spacing means also operate to prevent the bar from flexing a direction away from the spine and thereby impart additional rigidity to the starter bar.

BRIEF DESCRIPTION OF THE DRAWINGS

The invention is described in mode detail below with reference to the accompanying drawings, in which.

DETAILED DESCRIPTION WITH REFERENCE TO THE DRAWINGS

Figure 1A:
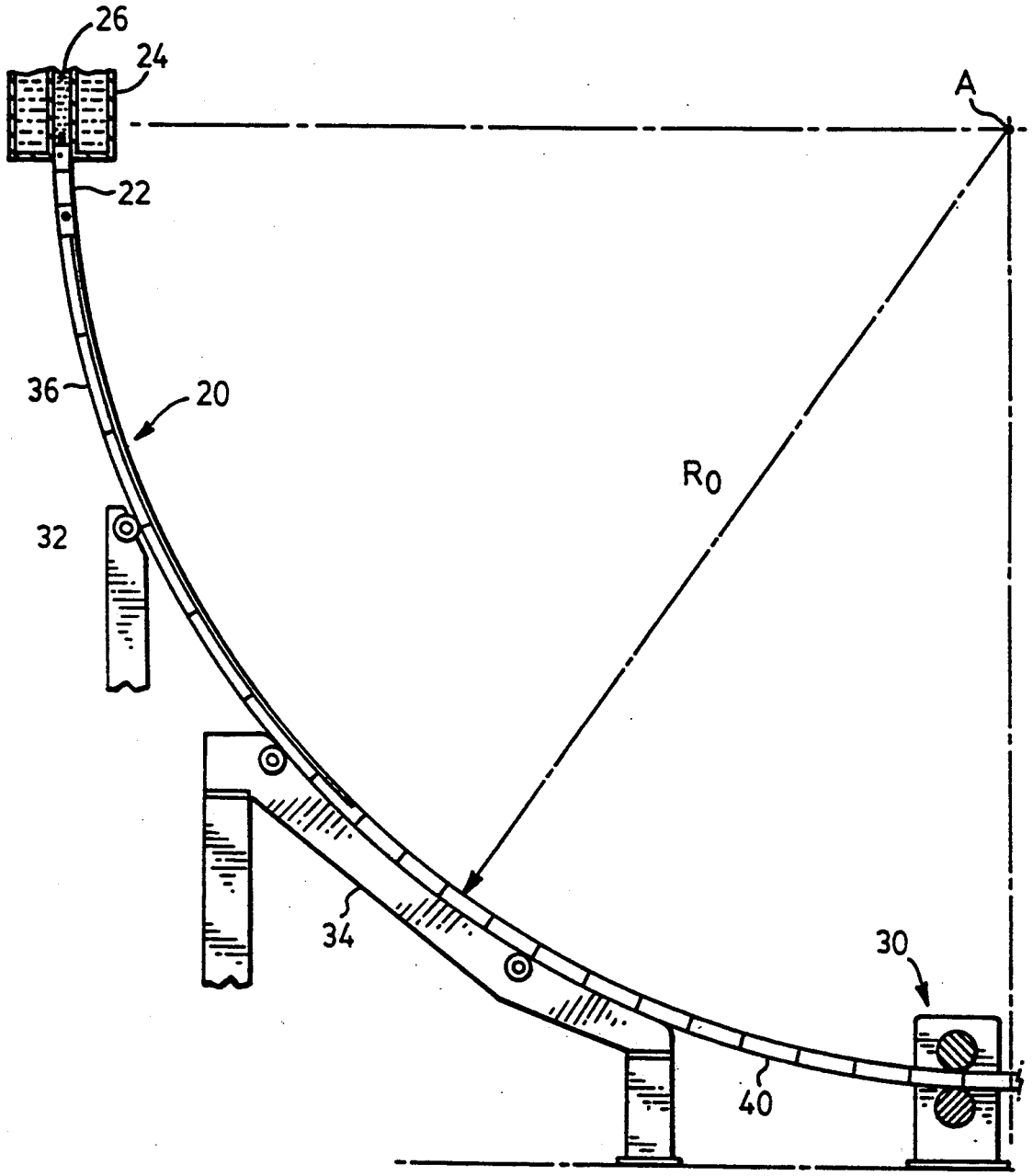
FIG. 1*a* is a schematic side elevation of a starter bar made according of the invention and positioned in sue between a continuous casting mold at the upstream end and extractor earls at the downstream end.

A starter bar made according to the invention generally indicated by numeral 20 is shown in FIG. 1*a* with its head 22 a the upstream end plugging a chilled mold 24. In use, molten metal 26 held in the mold 24 will freeze to the head 22 and form the leading end of a strand 218 (FIG. 1*b*) which is pulled through the continuous casting train by the starter bar 20. Extractor rolls 30 are provided on opposite sides of the starter bar 20 to grip the downstream end of the starter bar 20. The starter bar 20 is guided into a curved path of fixed radius Ro centered at A) and corresponding to the bating arc by a roller stand 32 positioned in the casting arc about 20° away from the mold 24 and by an arcuate skid 34 positioned between the roller stand 32 and the extractor rolls 30.

A rigid portion 36 comprising the starter bar 20 is disposed adjacent the head 22 and extends through approximately 20° to 30° of the casting arc according to whether it is a large radius casting machine and with an end portion resting partly on the guide skid 34. The starter bar 20 terminates in a tail 38 adjacent a flexible portion 40 sufficiently long to reach between a paid of straightening rolls positioned downstream of the extractor rolls 30 and comprising an upper roll 42 and a lower roll 44. The straightening rolls 42, 44 are operatively movable away from the casting arc so as to straighten the strand 28 into the configuration shown in solid lines in FIG. 1*b*.

Figure 1B:
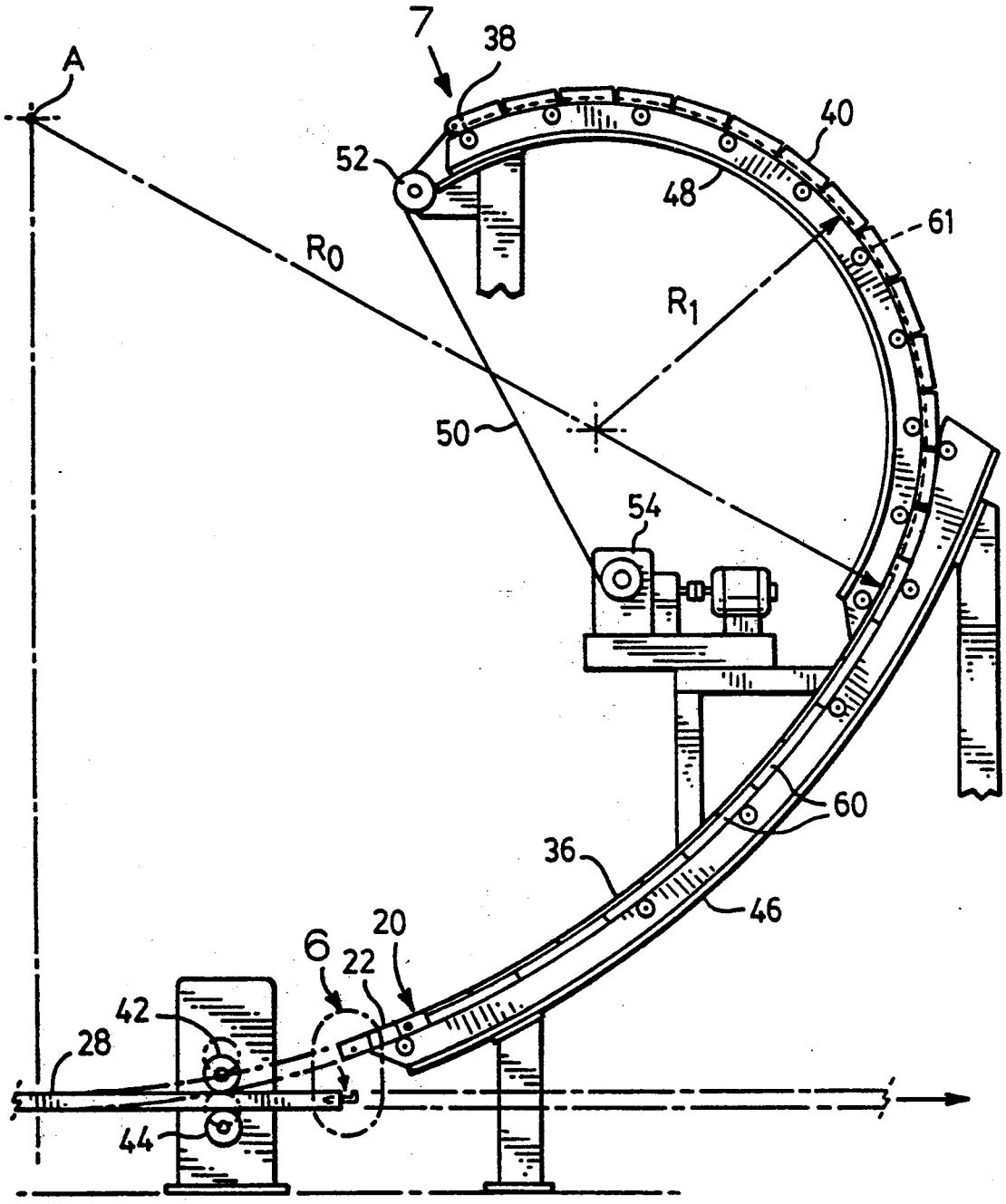
FIG. 1*b* is a schematic side elevational view showing the starter bar of FIG. 1*a* in a stored configuration; and a cast strand in ghost outline prior to separation from the starter bar and in solid line after such separation

The starter bar 20 is shown in its stored configuration in FIG. 1*b*. The rigid portion 36 is supported on a ramp 46 having a drains corresponding of the casting arc and disposed adjacent blocks 60 defining one side of the bar while the flexible portion 40 less on a curved support 48 having an end which is spaced from an overlaps the ramp 46 and which is disposed adjacent a spine 61 defining the other side of the bar.

The support 48 is shaped so that the flexible portion 40 assumes a transitional radius of curvature $R_1$ (typically 8–9 ft) smaller than the casting arc $R_0$ (typically 26 ft) and may assume a final radius of curvature $R_2$ (for example 3 ft) which sis till less than $R_1$.

A cable 50 attached to the tail 38 of the starter bar 20 is maintained in tension by an idler wheel 52 fixed adjacent the support 48 and a motorized wincing apparatus 54 adjusts the length thereof to release the starter bar or store the starter bar, as required.

Figure 2:
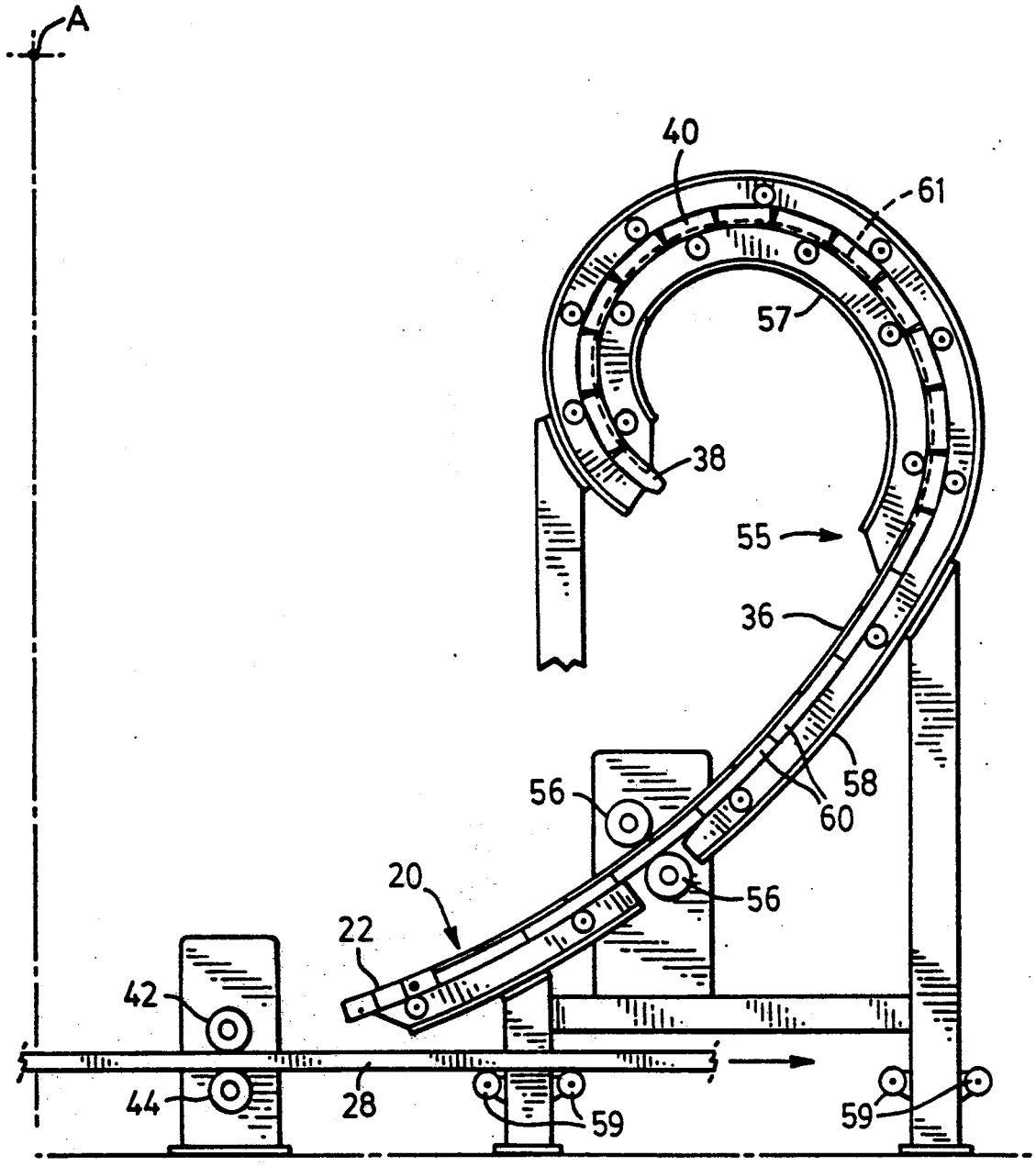
FIG. 2 is a similar view to FIG. 1*b* showing alternative storage means for the starter are according of the invention.

An alternative storage means 55 for the starter bar is shown in FIG. 2. Here, a pair of pinch rolls 56 positioned on opposite sides of the starter bar 20 operates to push the bar or withdraw the bar, as the case may be, from between an inner and an outer ramp 57, 58 transversely spaced from one another to accommodate the bar. The inner ramp 57, in use, extends throughout the length of the flexible portion 40 of the starter bar and overlaps at least one block of the rigid portion 36 so as to lie in supporting engagement with the side of the bar defined by the spine 61. The inner ramp 57 and the end portion of the outer ramp 58 are made to a radius of curvature which is constantly decreasing and substantially less than the radius $R_0$ of the casting arc. The operatively lower portion of the outer ramp 58 which supports the rigid portion 36 is disposed adjacent the blocks 60 and thus has a radius of curvature which equals the radius $R_0$ of the casting arc.

As can be seen in FIG. 2, the cast strand 28 passes under the storage means 55 over a run out table comprising rolls 59 where it is cut to suitable lengths.

The body of the starter bar, between the head 22 and the tail 38, will now be described with reference to FIG. 3. In the embodiment illustrated, the bar is adapted for use with a star and caster and accordingly has a generally rectangular cross-section. The bar 20 comprises a series of blocks 60, 62, 63 secured on one side to a common spine 61 comprising rigid segments 64 (drawn to the left) and flexible segments 66 (drawn to the right). In use, the spine 61 defines an inner radius of curvature for the starter bar while the blocks define an outer radius of curvature of the starter bar.

Figure 3:
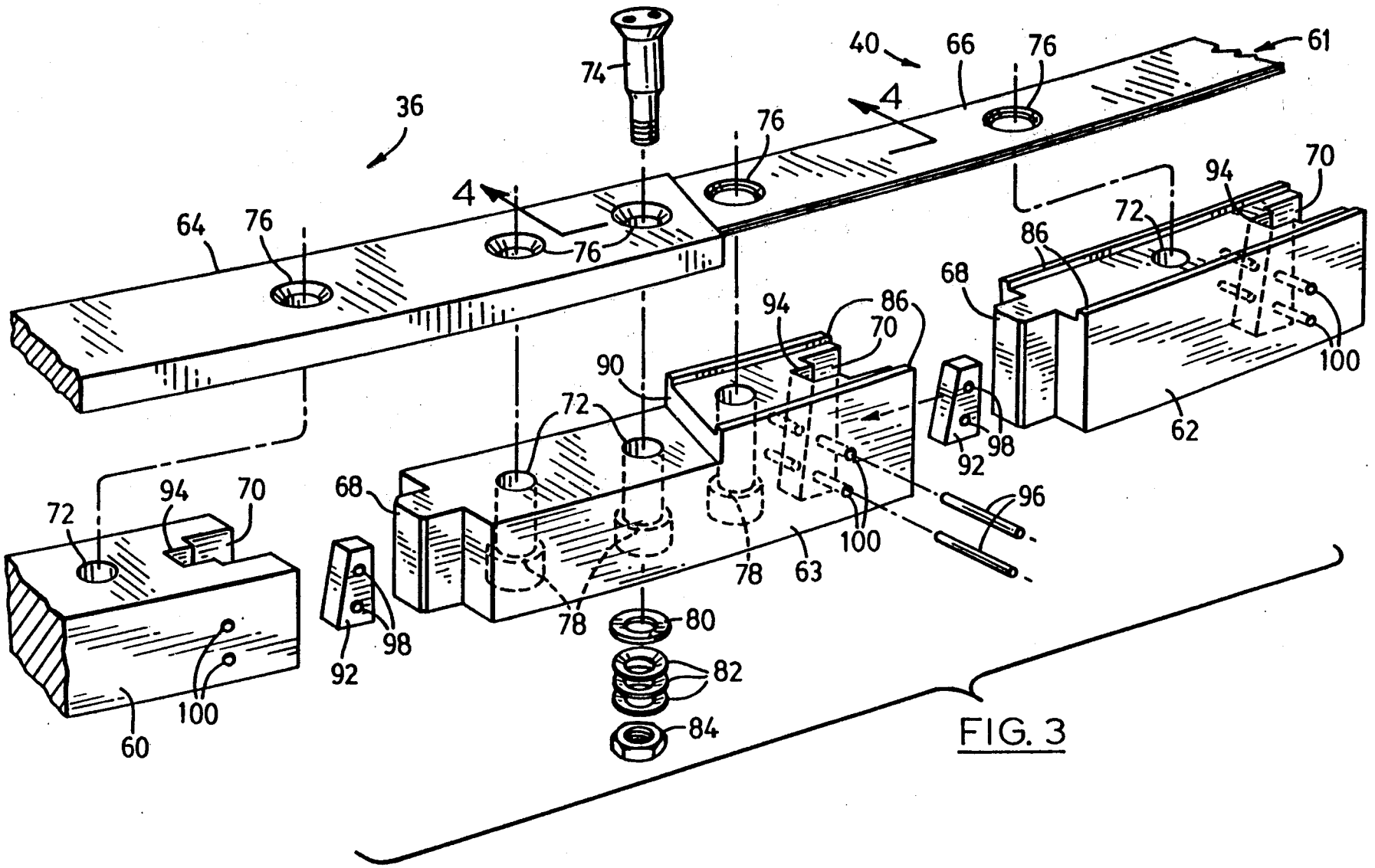
FIG. 3 is an exploded perspective view illustrating the component parts of the starter bart.

The blocks which comprise the rigid portion 36 of the bar 20 are designated by the numeral 60 and a representative block is drawn at the left hand side of FIG. 3. A block representative of the blocks in the flexible portion 40 of the bar is drawn at the right and designated by the numeral 62 and a special transition block located between the rigid portion 36 and the flexible portion 40 is designated by numeral 63. All those features which are common to the blocks 60, 62, 63 are designated by like numerals.

Thus, each block 60, 62, 63 has a tongue 68 at one end and a groove 70 at the other end adapted to cooperate with the groove and tongue, respectively, of adjacent blocks.

A number of through holes 72 extending between top and bottom surfaces of the blocks (as drawn) are machined from the centre of each block 60, 62, 63 are receive threaded fasteners 74 which secure the blocks to the associated segments 64, 66 of the spine 61. The spine has apertures 76 spaced from each other to correspond with the through holes 72 the blocks and countersunk to receive the conical heads of the fasteners 74 so that the fasteners locate beneath the surface of the spine.

The bottom of each of the through holes 72 is reamed to define a shoulder 78. In use, a washer 80 locates against the shoulder 78 with a set of Belville spring washers 82 between the washer 80 and a retaining nut 84 which is threaded on a reduced diameter portion of one of he fasteners 74.

The blocks 60, 62, 63 are machined form high carbon steel and in the rigid potion 36 are performed such that the upper and lower surface (as drawn) have a slight curvature which corresponds to the radius of the casting arc. The entire upper surface of the blocks 60 mates with the bottom surface of the spine segments 64 in the rigid portion 36. The spine segments 64 a made from a steel late having a thickness of about two inches and having a high fatigue resistance and are rolled to a curvature which is somewhat larger than the radius $R_0$. The blocks and the segments are sufficiently small to be also hardened by heat treatment to make home resistant to distortion by pinch roll forces.

Figure 4:
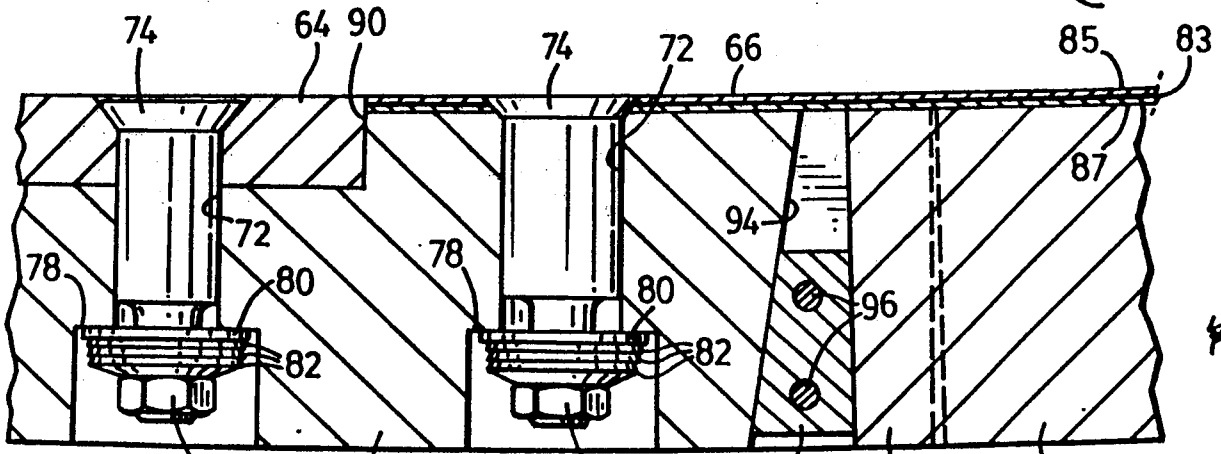
FIG. 4 is a sectional view through the starter bar taken on line 4—4 of FIG. 3.

The spine segments 66 in the flexible portion 40 have a thickness which is about ⅜"(9.5 mm) or one quarter the thickness of the spine segments 64 in the rigid portion 36. Additional flexibility is imparted of the segments 66 by their laminar construction which comprises a vibration isolator 83 made of synthetic plastic material (FIG. 4) cemented between upper and lower sheets 85, 87 of stainless steel each about ⅛ in. thick. A suggested material for use as a vibration isolator is sold under the trademark FABREEKA owned by Fabreeka International, Inc.

The spine segments 66 are located between a pair of oppositely directed shoulders 86 formed in the blocks 62 of the flexible portion 40 and extend along the length thereof thereby improving the lateral stability of the starter bar in the flexible potion. The depth of the shoulders is selected to be less than the spine thickness so that the spine segments 66 in the flexible portion 40 will protrude from the associated blocks 62 and together with the segments 64 in the rigid portion 36 will form a substantially continuous surface. For added flexibility, the blocks 62 in the flexible portion 40 are shorter in length than the blocks 60 in the rigid portion 36 they are less massive than the blocks in the rigid portion and each occupies a smaller segment of the casting arc.

The special transition block 63 located between the rigid portion 36 and the flexible portion 40 has a step 990 demarcating the junction where the segments 66 meet the segments 64. Since the segments 64, 66 have different thicknesses, one end of the transition block 63 (drawn to the right) has a greater height and similarly to the blocks 62 is provided with shoulders 86 to accommodate the segments 66 in the flexible portion 40 and impart some lateral stability to this portion.

As a first assembly step, the discrete blocks 60 of the rigid portion 36 and the transition block 63 are bolted to the spine segments 64 thus forming a relatively undefined radius larger than the final casting radius $R_0$ in accordance with the rolled radius of the spine segments 64.

This preliminary assembly is then clamped against a ib conforming exactly to the required shape of the inside radius of the bar and selected to equal the radius $R_0$ of the casting arc.

Spacing means in the form of tapered blocks 92 made of hardened steel are driven into slots 94 provided at the ends of the blocks adjacent the grooves 70 and secured by roll pins 96. The pins 96 traverse the tapered blocks 92 and the starter bar blocks 60, 62, 63 through respective apertures 98, 100 which are only machined once the vertical displacement of the tapered blocks 92 in the slots 94 is finalized and the inside radius of the bar matches the jib.

After this operation, the alignment jib can be removed and the rigid portion of the dummy bar will conform exactly to the radius $R_0$ of the casting arc.

Figure 5:
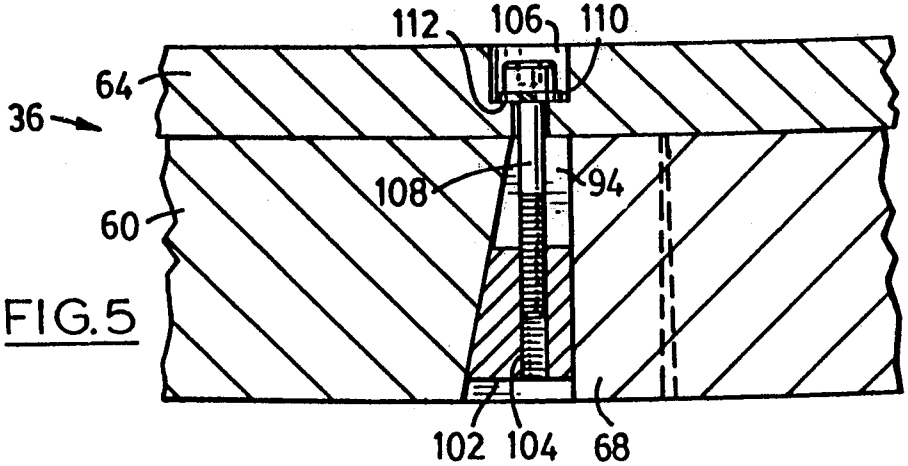
FIG. 5 is a similar view to FIG. 4 showing an alternative embodiment of spacer means provided between component blocks of the starter bar.

In an alternative embodiment of the invention shown in FIG. 5, the spacing means between the blocks 60 of the rigid portion 36 are provided in the form of tapered blocks 102 which ave a vertically oriented threaded bore 104. The spine segments 64 have aperture 106 which receive long bolts 108 and which mate in the bores 104 to adjust the vertical displacement of the spacing blocks 102 between the blocks 60 of the starter bar. A lock washer 10 locates against a shoulder 112 defined by reaming the apertures 106.

The spacing means between the blocks 62 in the flexible portion 40 will likewise be positioned to determine the maximum radius of curvature in this portion. Conveniently, the radius may be selected to equal an infinite radius so that the flexible portion may e pre-assembled and shipped in a straight configuration.

For completeness, the details of the head 22 and the tail 38 will be described although these may be constructed in any conventionally accepted manner.

Figure 6:
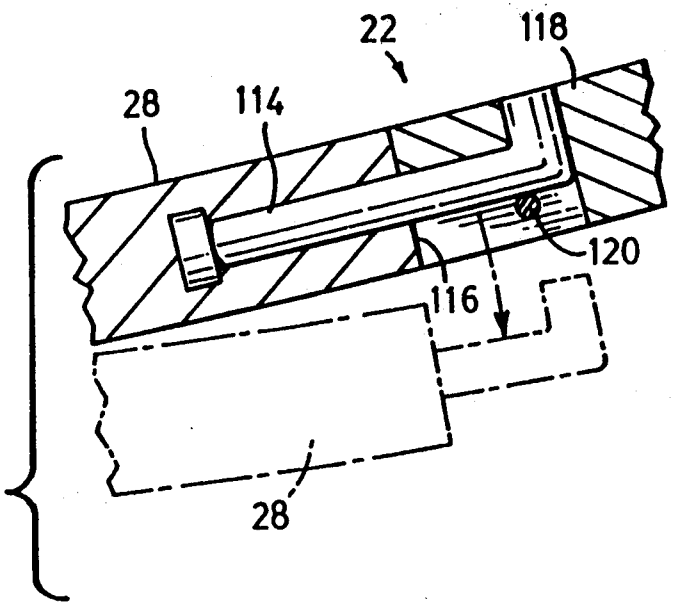
FIG. 6 (drawn to a smaller scale) is a detailed view of area 6 in FIG. 1*b* showing the connection between the head of the starter bar and the leading end of a casting.
Figure 7:
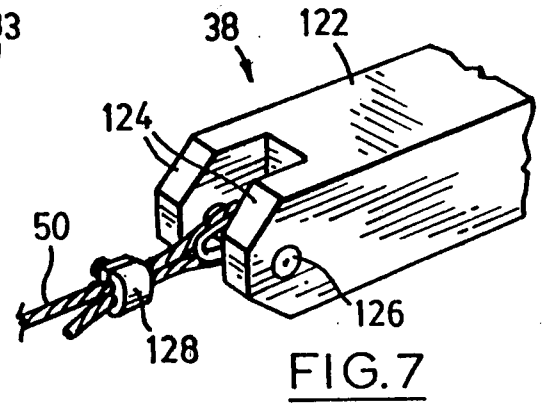
FIG. 7 (drawn to a smaller scale) is a detailed view at arrow 7 in FIG. 1*b* showing the tail of the starter bar according of the invention.

The head 22 is shown in FIG. 6 attached to the strand 28 by a consumable pin 114 having an L-shaped end which is located in a complementary recess 116 shaped into a terminal block 118 comprising the head 22 and secured by a transverse pin 120. The head 22 is severed from the strand 28 by the straightener rolls 42, 44 urging the strand 28 away from the casting arc as shown in ghost outline in FIG. 6. In the process, the transverse pin 120 is sheared and must be replaced before reusing the starter bar.

The tail 38 comprises another terminal block 122 having transversely spaced lugs 124 apertured to receive a pin 126 around which the winch cable 50 is secured by a clamp 128.

In use, it will be understood that the heat treatment of the blocks and spine segments will cause some minor distortion. However, the assembled starter bar will have an effective radius of curvature which will more closely match the radius of the casting arc than any comparable rib is bar known to the applicant. Moreover, the resistance of the rigid portion in particular to straightening forces in the outward direction (away from the spine 61) will be greater because the bar will have been constructed from strengthened components and because of the compressive forces imparted by the spacing means.

Conversely, the flexible portion is constructed to minimize resistance to inwardly directed forces (toward the spine 61), thereby allowing the bar to curl into a very small radius, typically 3 ft. (91 cm). Conveniently, this allows the starter bar to be stored with a minimum of headroom being required.

It will be understood that several variations may be made of the above-described embodiments of the invention within the scope of of the appended claims as illustrated in part by the variations described with reference to FIGS. 2 and 5.

I claim:

1. A starter bar for closing a mold in a continuous casting machine and for guiding the leading end of a casting from the mold in a curved casting path, the starter bar having a head at one end of the bar for attachment to the leading end of the casting, a tail at the other end of the bar for guiding the bar between rollers forming part of the continuous casting machine, and a body disposed between the head and the tail including a flexible first portion adjacent the tail and a substantially rigid second portion adjacent the head, the body comprising:

a spine disposed on an operatively inner side of the body and defining an inner radius of curvature for the starter bar lying in said curved casting path;

a series of blocks disposed on an operatively outer side of the body arranged end to end and attached on one side thereof to the operatively outer surface of the spine, the blocks thereby defining an outer radius of curvature for the starter bar lying in said curved casting path; and a plurality of spacing means corresponding in number to the blocks disposed between respective pairs of blocks, the spacing means being arranged so that the blocks will lie in a self-supporting abutting relationship when the starter bar is in a curved configuration corresponding to said curved casting path and adapted to prevent the bar from flexing in a direction away from the spine, the spine in the flexible first portion of the starter bar being substantially more flexible than in the rigid second portion of the starter bar, the associated blocks being adapted to allow the first portion to be bent to a radius of curvature which is substantially less than the radius of curvature of said curved casting path.

2. Starter bar according to claim 1 in which the spine is segmented into a series of plates arranged end to end.

3. Starter bar according to claim 1 in which the spine of the rigid second portion is thicker than the spine of the flexible first portion.

4. Starter bar according to claim 1 in which the blocks of the rigid portion are more massive than the blocks in the flexible portion and each block in the rigid portion occupies a greater segment of the arc than the blocks in the flexible portion.

5. Starter bar according to claim 1 in which the spine of the flexible first portion comprises a laminated structure of which an outer layer comprises a metal sheet and an inner layer comprises a synthetic plastic material and the associated blocks have oppositely directed shoulders extending along the length thereof for receiving the spine therebetween and imparting lateral stability to the spine in said flexible first portion.

6. Starter bar according to claim 5 in which the spine of the rigid second portion comprises a steel plate having a thickness of bout two inches and in which the metal sheets comprising the flexible first portion are about $\frac{1}{8}$ in. thick with the synthetic plastic layer having a thickness of about $\frac{1}{8}$ in.

* * * * *